US011335523B2

(12) United States Patent
Swing, III

(10) Patent No.: US 11,335,523 B2
(45) Date of Patent: May 17, 2022

(54) SUPPORT FOR ELECTRICAL SWITCH

(71) Applicant: Hubbell Incorporated, Shelton, CT (US)

(72) Inventor: Donald Fletcher Swing, III, Birmingham, AL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/893,198

(22) Filed: Jun. 4, 2020

(65) Prior Publication Data

US 2020/0388453 A1 Dec. 10, 2020

Related U.S. Application Data

(60) Provisional application No. 62/857,064, filed on Jun. 4, 2019, provisional application No. 62/881,675, filed on Aug. 1, 2019.

(51) Int. Cl.
*H01H 31/20* (2006.01)

(52) U.S. Cl.
CPC ..... *H01H 31/20* (2013.01)

(58) Field of Classification Search
CPC ..... H01H 31/20; H01H 31/02; H01H 31/023; H01H 31/28; H01H 31/30; H01H 33/00; H01H 33/02; H01H 9/00
USPC ..... 200/48 R, 48 CB, 48 SB; 218/149, 150, 218/153, 154
See application file for complete search history.

(56) References Cited

U.S. PATENT DOCUMENTS

| | | | | |
|---|---|---|---|---|
| 2,660,631 A | | 11/1953 | Harrison | |
| 3,005,063 A | | 10/1961 | Zemels | |
| 3,566,056 A | * | 2/1971 | Joseph | H01H 31/026 200/48 A |
| 3,627,939 A | * | 12/1971 | Myers | H01H 1/38 200/48 SB |
| 3,649,094 A | | 3/1972 | Russell | |
| 3,745,274 A | | 7/1973 | Cole | |
| 4,103,120 A | | 7/1978 | Jarosz et al. | |
| 4,596,906 A | | 6/1986 | Chabala et al. | |
| 5,293,012 A | * | 3/1994 | Levi | H01H 31/28 200/275 |
| 6,927,355 B2 | | 8/2005 | Thuresson | |
| 6,946,607 B2 | * | 9/2005 | Roberts | H01H 31/006 200/48 A |
| 6,967,302 B2 | | 11/2005 | Peter | |
| 9,099,266 B2 | * | 8/2015 | Rhein | H01H 31/28 |
| 9,127,716 B2 | | 9/2015 | Kamamoto | |

(Continued)

FOREIGN PATENT DOCUMENTS

CN 204375626 6/2015

OTHER PUBLICATIONS

PCT/US2020/036164 International Search Report and Written Opinion dated Aug. 18, 2020 (18 pages).

*Primary Examiner* — William A Bolton
(74) *Attorney, Agent, or Firm* — Michael Best & Friedrich LLP

(57) ABSTRACT

A support for a high-voltage electric switch includes a housing, a shaft, and an intermediate member positioned between the housing and the shaft. The shaft extends at least partially through the housing, and the shaft is supported for rotation about an axis. The intermediate member is supported for rotation relative to the shaft and supported for rotation relative to the housing.

20 Claims, 5 Drawing Sheets

(56) References Cited

U.S. PATENT DOCUMENTS

| | | | | |
|---|---|---|---|---|
| 10,167,896 | B2 | 1/2019 | Malychok | |
| 2015/0155119 | A1* | 6/2015 | Zhu | H01H 31/28 200/48 A |
| 2019/0206643 | A1 | 7/2019 | Boehm | |

* cited by examiner

SUPPORT FOR ELECTRICAL SWITCH

REFERENCE TO RELATED APPLICATIONS

This application claims the benefit of U.S. Provisional Patent Application No. 62/857,064, filed Jun. 4, 2019, and U.S. Provisional Patent Application No. 62/881,675, filed Aug. 1, 2019. The entire contents of these applications are incorporated by reference.

BACKGROUND

This application relates to high-voltage electrical switches, and particularly to a support shaft for a high-voltage electrical switch.

SUMMARY

In one independent aspect, a support for a high-voltage electric switch includes a housing, a shaft, and an intermediate member positioned between the housing and the shaft. The shaft extends at least partially through the housing, and the shaft is supported for rotation about an axis. The intermediate member is supported for rotation relative to the shaft and supported for rotation relative to the housing.

In some aspects, the intermediate member is supported for rotation relative to the shaft by at least one first bearing, and the intermediate member is supported for rotation relative to the housing by at least one second bearing.

In some aspects, the first bearing includes a first inner race engaging the shaft and a first outer race engaging the intermediate member, and the second bearing includes a second inner race engaging the intermediate member and a second outer race engaging the housing.

In some aspects, the support further includes a retainer positioned adjacent an end of the intermediate member.

In some aspects, the retainer retains the second bearing.

In some aspects, the intermediate member is operable to rotate about the axis while the shaft and the housing remain stationary.

In another independent aspect, a support for a high-voltage electric switch includes a housing, a shaft, and a sleeve positioned between the housing and the shaft. The shaft extends at least partially through the housing and the shaft supported for rotation about an axis. One end of the shaft is configured to be coupled to a switch member movable between an open position and a closed position. The sleeve is rotatable relative to the shaft and rotatable relative to the housing.

In some aspects, the support further includes a first bearing positioned between the shaft and the sleeve, the first bearing supporting the shaft for rotation relative to the sleeve.

In some aspects, the first bearing includes an inner race engaging the shaft and an outer race engaging the sleeve.

In some aspects, the support further includes a second bearing positioned between the housing and the sleeve, and the second bearing supports the sleeve for rotation relative to the housing.

In some aspects, the second bearing includes an inner race engaging the sleeve and an outer race engaging the housing.

In some aspects, the support further includes a retainer positioned adjacent an end of the sleeve.

In some aspects, a portion of the retainer is configured to be engaged by a tool to facilitate manual rotation of the sleeve while the shaft and the housing remain stationary.

In some aspects, the retainer abuts a bearing supporting the sleeve for rotation relative to the housing.

In yet another independent aspect, a high-voltage electric switch includes: a first electrical terminal configured to be supported on a frame; a second electrical terminal configured to be supported on the frame; a conducting member for providing electrical communication between the first electrical terminal and the second electrical terminal; and a shaft assembly supporting one of the first electrical terminal and the second electrical terminal for pivoting movement to move the conducting member between a first position and a second position. The conducting member provides electrical communication between the first electrical terminal and the second electrical terminal while the conducting member is in the first position, and electrical communication between the first electrical terminal and the second electrical terminal is inhibited while the conducting member is in the second position. The shaft assembly includes a housing, a shaft extending at least partially through the housing, and an intermediate member positioned between the housing and the shaft. The shaft is supported for rotation about an axis. The intermediate member is supported for rotation relative to the shaft and supported for rotation relative to the housing.

In some aspects, the intermediate member is supported for rotation relative to the shaft by at least one first bearing, and the intermediate member is supported for rotation relative to the housing by at least one second bearing.

In some aspects, the first bearing includes a first inner race engaging the shaft and a first outer race engaging the intermediate member, and the second bearing includes a second inner race engaging the intermediate member and a second outer race engaging the housing.

In some aspects, the shaft assembly further includes a retainer positioned adjacent an end of the intermediate member.

In some aspects, a portion of the retainer is configured to be engaged by a tool to facilitate manual rotation of the intermediate member while the shaft and the housing remain stationary.

In some aspects, the retainer abuts a bearing supporting the intermediate member for rotation relative to the housing.

Other aspects of the shaft assembly will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

DETAILED DESCRIPTION

Some high-voltage electrical switches (for example, operating at voltages of 1000 V or greater) are actuated by rotating one or more of the supports on which the equipment is mounted. In addition to facilitating rotation, a switch support must support the weight of the parts and support the cantilever loading of the parts without affecting the switch's ability to operate satisfactorily. It is also necessary for the support to withstand weather without developing rust or other corrosion. In some cases, rust/corrosion can completely lock bearings such that an operator must force the switch(es) open with an external tool, which can be dangerous at high voltage. Furthermore, most high-voltage switches are operated (e.g., actuated to an open state) infrequently-many switches may be operated once every two years, and some are operated even less frequently. Even when operated, the switch may be rotated only partially (e.g., rotated about 90 degrees).

Figure 1:
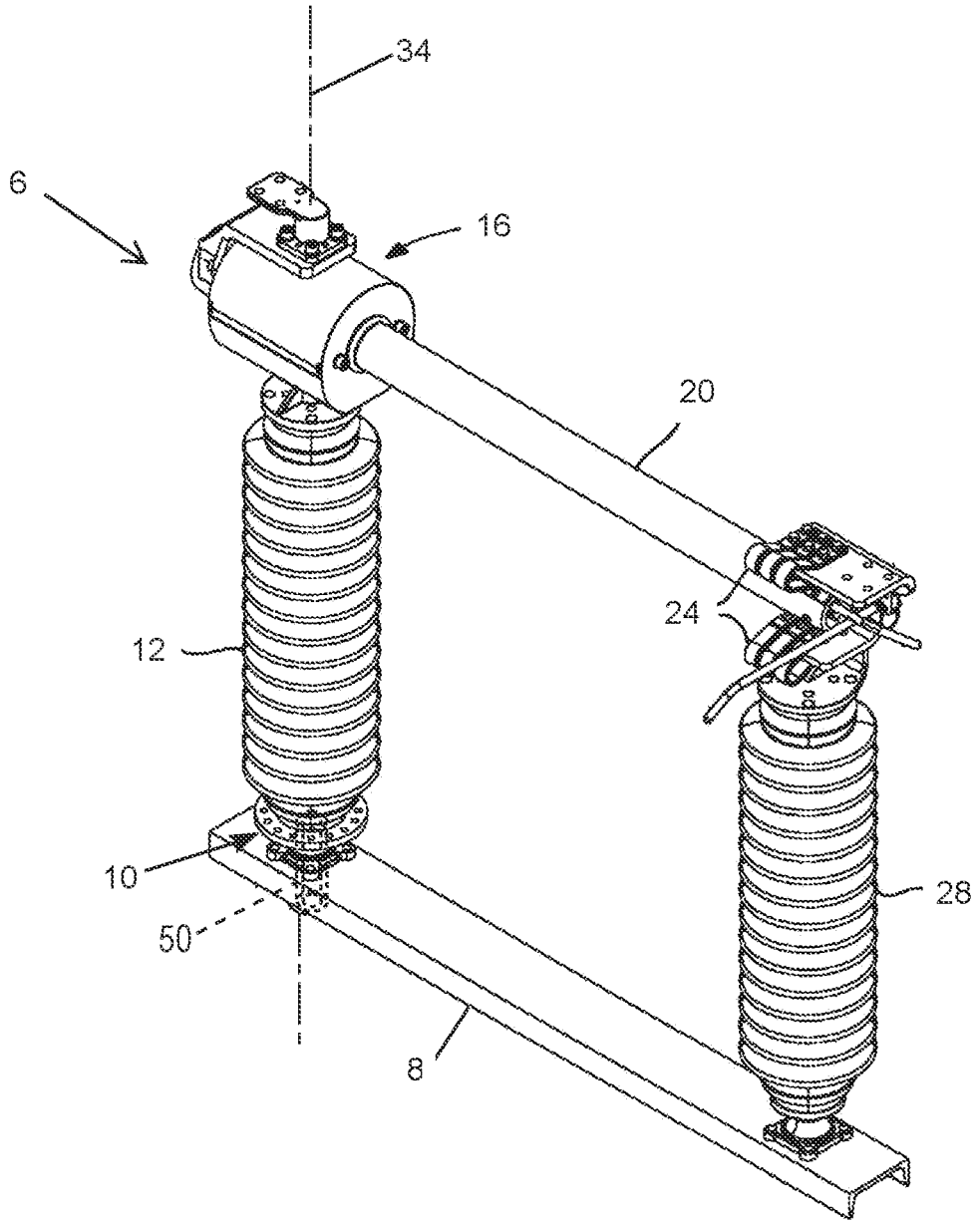
FIG. 1 is a perspective view of a high-voltage electrical switch in a closed state.
Figure 2:
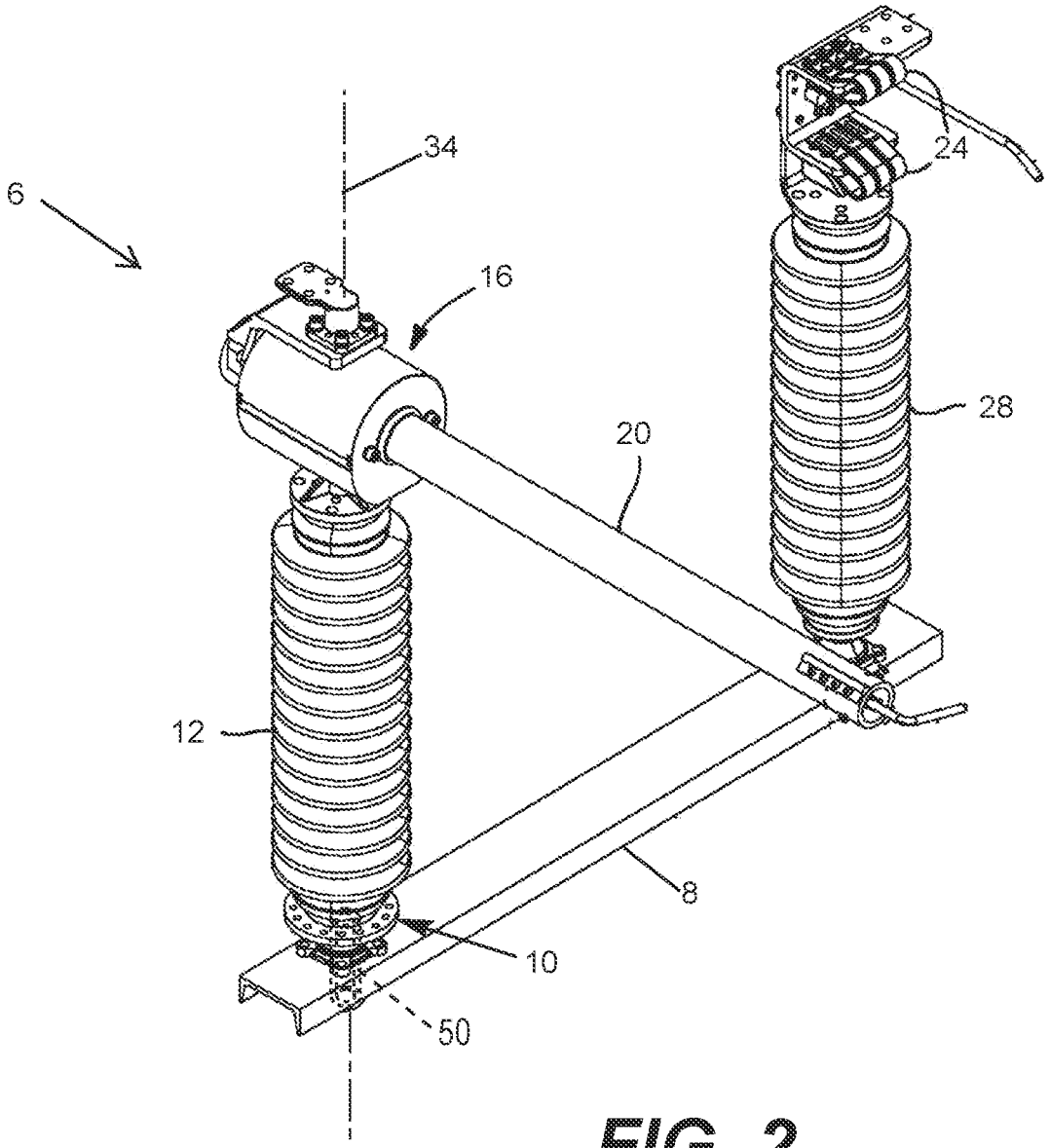
FIG. 2 is a perspective view of the high-voltage electrical switch in an open state.

FIGS. 1 and 2 show an exemplary high-voltage electrical switch 6. In the illustrated embodiment, the electrical switch 6 is supported on a frame member 8 that may be connected to a utility structure (not shown). The switch 6 is supported by a shaft assembly 10 connected to the frame member 8. A first insulator 12 and a blade support 16 are supported by the shaft assembly 10 for pivoting movement relative to the frame member 8. The first insulator 12 is positioned between the shaft assembly 10 and the blade support 16. The blade support 16 is coupled to an electrically conductive arm or blade 20, which can be selectively positioned to engage terminal contacts 24 to close the switch (FIG. 1). The contacts 24 may be positioned on top of a second insulator 28. As shown in FIG. 2, the shaft assembly 10 supports the blade support 16 and blade 20 for pivoting about an axis 34, permitting the blade 20 to move away from the terminal contacts 24 and open the switch.

Figure 3:
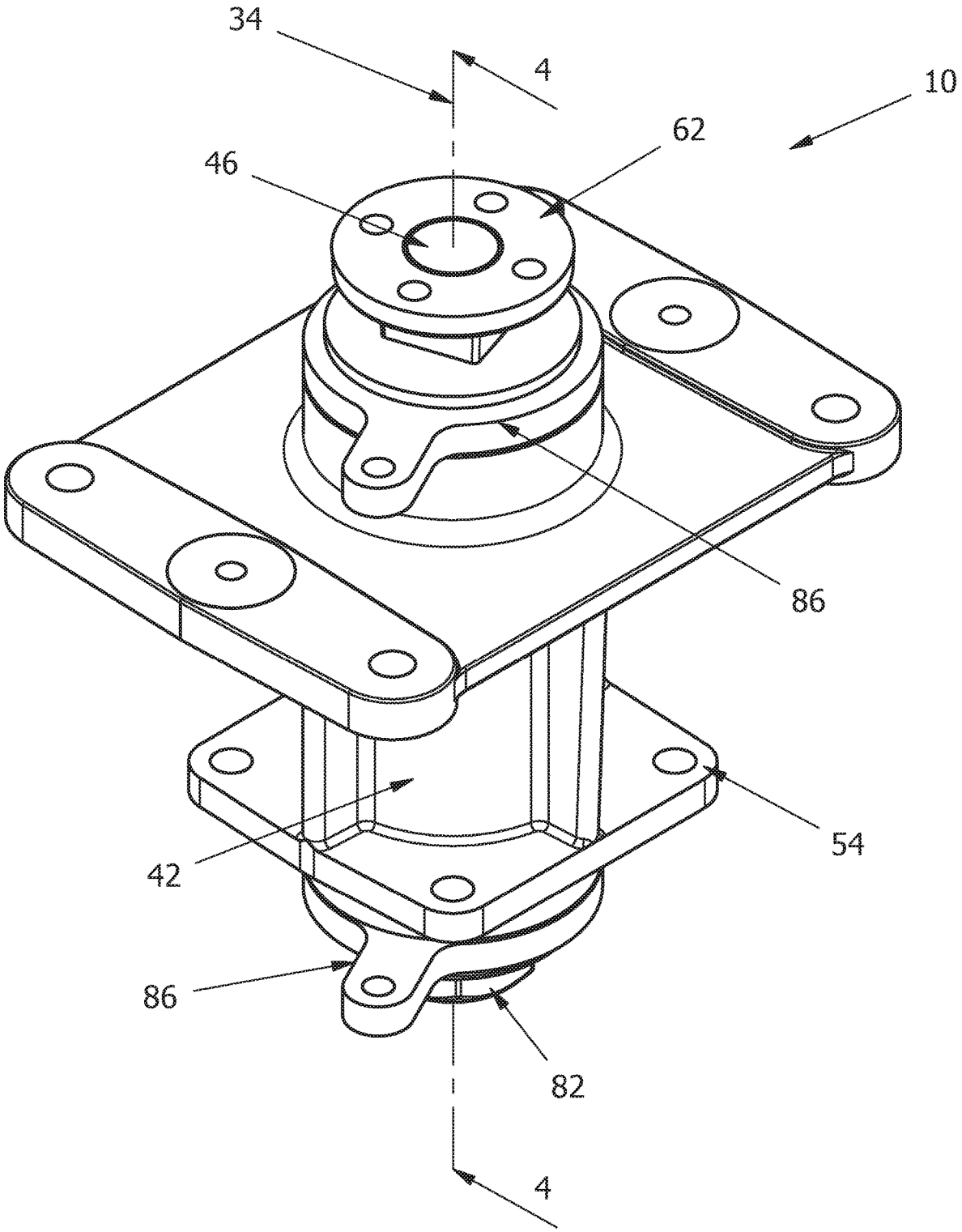
FIG. 3 is a perspective view of a shaft assembly.
Figure 4:
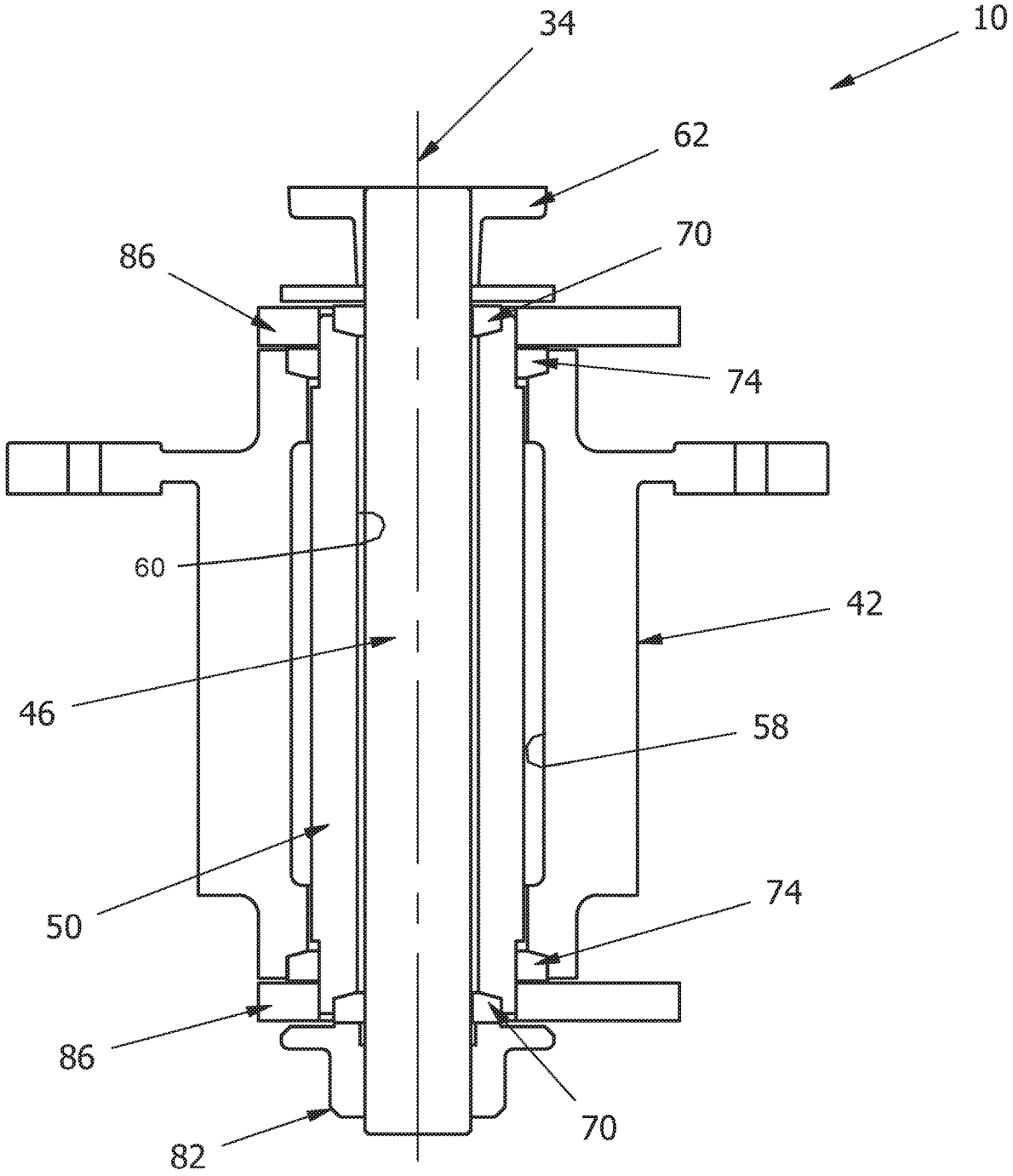
FIG. 4 is a cross-sectional view of the shaft assembly of FIG. 3, viewed along section 4-4.

FIGS. 3 and 4 illustrate a shaft assembly 10 of a high-voltage electrical switch. The shaft assembly 10 includes a support block 42, a first member or main shaft 46, and a second member or sleeve 50. The support block 42 includes a flange 54 that is secured to the frame member 8 (FIG. 1), and also includes a bore 58 (FIG. 4). The main shaft 46 passes through the bore 58 along the axis 34. One end of the main shaft 46 is secured to a base 62 on which the insulator 12 (FIG. 1) may be supported.

Figure 5:
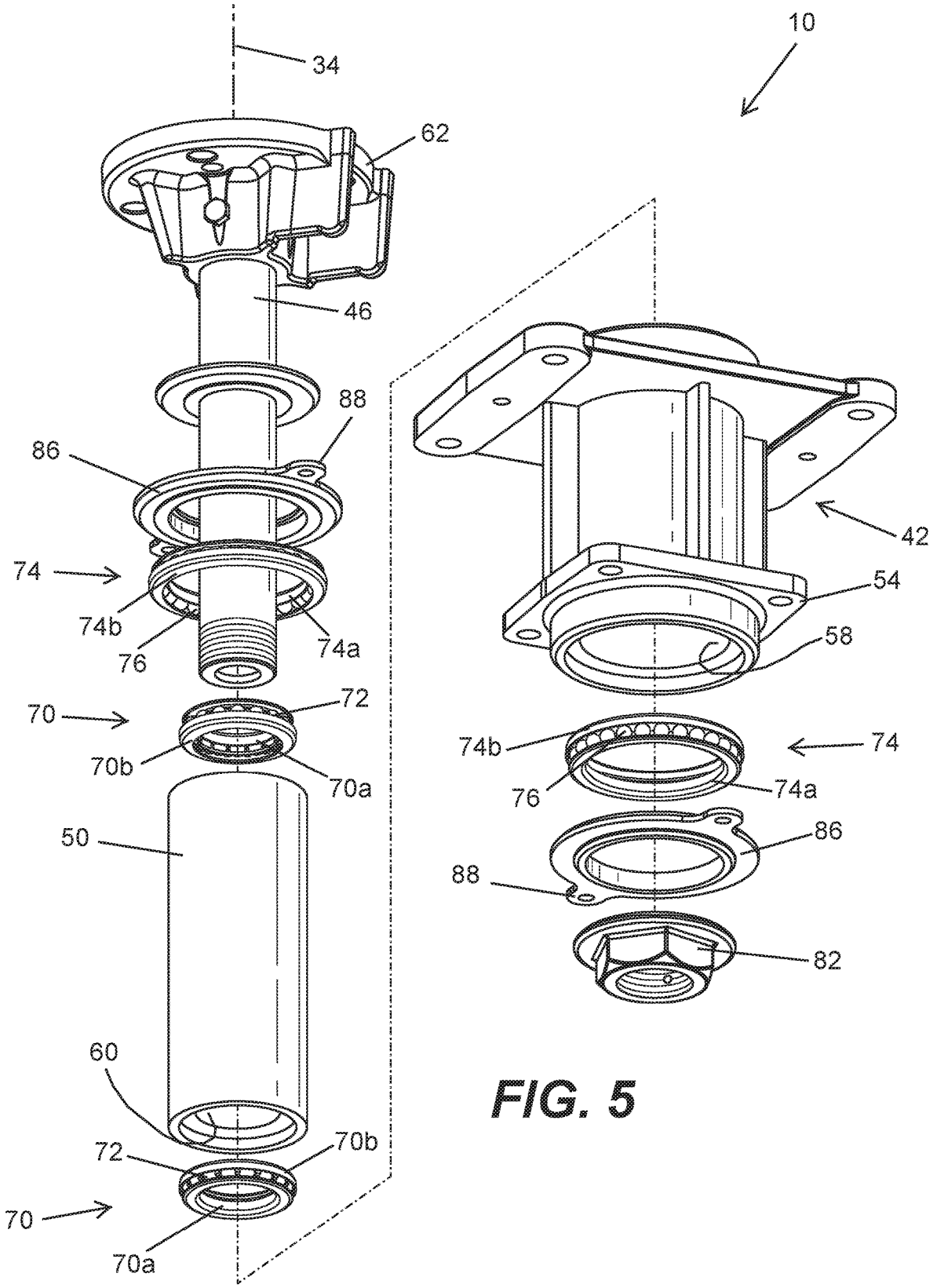
FIG. 5 is an exploded perspective view of the shaft assembly.

As shown in FIGS. 4 and 5, the sleeve 50 is positioned within the bore 58 of the support block 42, between the main shaft 46 and the support block 42. Stated another way, the main shaft 46 passes through an opening 60 of the sleeve 50. The support block 42, the sleeve 50, and the main shaft 46 are each rotatable relative to one another. In particular, a pair of first bearings 70 support the main shaft 46 for rotation relative to the sleeve 50, and a pair of second bearings 74 support the sleeve 50 for rotation relative to the support block 42. In the illustrated embodiments, the bearings 70, 74 are roller ball bearings.

As shown in FIG. 5, in the illustrated embodiment, each of the first bearings 70 may include a first inner race 70*a* engaging an outer surface of the main shaft 46, a first outer race 70*b* engaging an inner surface of the sleeve 50, and a plurality of roller elements 72 (e.g., balls) positioned between the first inner race 70*a* and the first outer race 70*b*. In some embodiments, each of the first bearings 70 may include a cage or interior member (not shown) to maintain the positions of the balls 72 relative to one another. Each of the second bearings 74 may have a similar construction-specifically, each of the second bearings 74 may include a second inner race 74*a* engaging an outer surface of the sleeve 50, a second outer race 74*b* engaging an inner surface of the support block 42, and a plurality of roller elements 76 (e.g., balls) positioned between the second inner race 74*a* and the second outer race 74*b*. In some embodiments, each of the second bearings 74 may include a cage or interior member (not shown) to maintain the positions of the balls 76 relative to one another.

Also, in the illustrated embodiment, a nut 82 threadably engages an end of the main shaft 46 opposite the base 62, thereby retaining the first bearings 70 in engagement between the sleeve 50 and the main shaft 46. In addition, a retainer 86 is positioned adjacent one end of the sleeve 50, and a similar retainer 86 is positioned adjacent an opposite end of the sleeve 50.

As shown in FIG. 3, each of the retainers 86 can be engaged by a tool (not shown) to facilitate rotation of the sleeve 50 while the main shaft 46 and the support block 42 remain stationary. In the illustrated embodiment, a flange 88 of the retainer 86 can be engaged by the tool. In some embodiments, an adapter plate can be coupled to one or both of the retainers 86 to permit a technician to rotate the sleeve 50 by using an insulated operating pole or similar device. Also, in some embodiments, an assembly could connect the sleeves 50 of multiple shaft assemblies 10 to actuate the sleeves 50 at the same time.

Rotation of the sleeve 50 cycles or exercises the bearings 70, 74 without requiring the switch 6 to change position. The rotation assists in performing maintenance on the bearings 70, 74 and the overall assembly. In addition, the actuation allows a technician to detect if any of the bearings 70, 74 have seized, rather than requiring the switch be physically opened (and avoiding the need to wait for an opportunity when the switch can be opened) to determine that the bearings have failed.

Although aspects have been described in detail with reference to certain preferred embodiments, variations and modifications exist within the scope and spirit of one or more independent aspects as described. Various features and advantages are set forth in the following claims.

What is claimed is:

1. A support for a high-voltage electric switch, the support comprising:

a housing;

a shaft extending at least partially through the housing, the shaft supported for rotation about an axis, one end of the shaft configured to be coupled to a switch member movable between an open position and a closed position; and an intermediate member positioned between the housing and the shaft, the intermediate member being supported for rotation relative to the shaft and supported for rotation relative to the housing, the intermediate member operable to be manually rotated without moving the switch member.

2. The support of claim 1, wherein the intermediate member is supported for rotation relative to the shaft by at least one first bearing, and the intermediate member is supported for rotation relative to the housing by at least one second bearing.

3. The support of claim 2, wherein the first bearing includes a first inner race engaging the shaft and a first outer race engaging the intermediate member, wherein the second bearing includes a second inner race engaging the intermediate member and a second outer race engaging the housing.

4. The support of claim 1, further comprising a retainer positioned adjacent an end of the intermediate member.

5. The support of claim 4, wherein the intermediate member is supported for rotation relative to the shaft by at least one first bearing, and the intermediate member is supported for rotation relative to the housing by at least one second bearing, wherein the retainer retains the second bearing.

6. The support of claim 1, wherein the intermediate member is operable to rotate about the axis while the shaft and the housing remain stationary.

7. A support for a high-voltage electric switch, the support comprising:

a housing;

a shaft extending at least partially through the housing, the shaft supported for rotation about an axis, one end of the shaft configured to be coupled to a switch member movable between an open position and a closed position; and a sleeve positioned between the housing and the shaft, the sleeve being rotatable relative to the shaft and rotatable relative to the housing, the sleeve configured to be independently rotated while the shaft and the housing remain stationary.

8. The support of claim 7, further comprising a first bearing positioned between the shaft and the sleeve, the first bearing supporting the shaft for rotation relative to the sleeve.

9. The support of claim 8, wherein the first bearing includes an inner race engaging the shaft and an outer race engaging the sleeve.

10. The support of claim 7, further comprising a second bearing positioned between the housing and the sleeve, the second bearing supporting the sleeve for rotation relative to the housing.

11. The support of claim 10, wherein the second bearing includes an inner race engaging the sleeve and an outer race engaging the housing.

12. The support of claim 7, further comprising a retainer positioned adjacent an end of the sleeve.

13. The support of claim 12, wherein a portion of the retainer is configured to be engaged by a tool to facilitate manual rotation of the sleeve while the shaft and the housing remain stationary.

14. The support of claim 12, wherein the retainer abuts a bearing supporting the sleeve for rotation relative to the housing.

15. A high-voltage electric switch comprising:

a first electrical terminal configured to be supported on a frame;

a second electrical terminal configured to be supported on the frame;

a conducting member for providing electrical communication between the first electrical terminal and the second electrical terminal; and a shaft assembly supporting one of the first electrical terminal and the second electrical terminal for pivoting movement to move the conducting member between a first position and a second position, the conducting member providing electrical communication between the first electrical terminal and the second electrical terminal while the conducting member is in the first position, electrical communication between the first electrical terminal and the second electrical terminal being inhibited while the conducting member is in the second position, the shaft assembly including, a housing, a shaft extending at least partially through the housing, the shaft supported for rotation about an axis, and an intermediate member positioned between the housing and the shaft, the intermediate member being supported for rotation relative to the shaft and supported for rotation relative to the housing, the intermediate member configured to be independently rotated while the shaft and the housing remain stationary.

16. The electrical switch of claim 15, wherein the intermediate member is supported for rotation relative to the shaft by at least one first bearing, and the intermediate member is supported for rotation relative to the housing by at least one second bearing.

17. The electrical switch of claim 16, wherein the first bearing includes a first inner race engaging the shaft and a first outer race engaging the intermediate member, wherein the second bearing includes a second inner race engaging the intermediate member and a second outer race engaging the housing.

18. The electrical switch of claim 15, further comprising a retainer positioned adjacent an end of the intermediate member.

19. The electrical switch of claim 18, wherein a portion of the retainer is configured to be engaged by a tool to facilitate manual rotation of the intermediate member while the shaft and the housing remain stationary.

20. The electrical switch of claim 18, wherein the retainer abuts a bearing supporting the intermediate member for rotation relative to the housing.

* * * * *